US005934637A

United States Patent [19]

Robinson

[11] Patent Number: 5,934,637

[45] Date of Patent: Aug. 10, 1999

[54] COIN CUP HOLDER FOR A TOILET STALL

[76] Inventor: Michael Robinson, 19 N. 3rd St., Pleasantville, N.J. 08232

[21] Appl. No.: 08/910,153

[22] Filed: Aug. 13, 1997

[51] Int. Cl.[6] ..... A47K 1/08

[52] U.S. Cl. ..... 248/311.2; 211/85.9; 248/914

[58] Field of Search ..... 248/311.2, 305, 248/341, 339, 304, 914; 211/13.1, 58.9, 87.01

[56] References Cited

U.S. PATENT DOCUMENTS

| | | | |
|---|---|---|---|
| D. 71,202 | 10/1926 | Nitsche | D6/531 |
| D. 341,624 | 11/1993 | Evenson et al. | D19/77 |
| 489,593 | 1/1893 | Ramer | 312/280 |
| 679,807 | 8/1901 | Werum | 211/85.13 |
| 776,332 | 11/1904 | Kloeppinger | 211/75 |
| 897,072 | 8/1908 | Eckhardt | 126/229 |
| 1,215,495 | 2/1917 | Crum | 248/205.1 |
| 1,451,119 | 4/1923 | Schroeder et al. | 248/108 |
| 1,615,571 | 1/1927 | Crecelius | 248/108 |
| 1,975,691 | 10/1934 | Hibbs | 248/63 |
| 2,200,046 | 5/1940 | Straus | 132/290 |
| 2,765,998 | 10/1956 | Engert | 248/467 |
| 2,894,639 | 7/1959 | Caporicci | 108/59 |
| 3,579,745 | 5/1971 | Wilson | 24/307 |
| 3,994,465 | 11/1976 | Rudnitzky | 248/311.2 |
| 4,140,222 | 2/1979 | Francavilla | 211/65 |
| 4,304,403 | 12/1981 | Wilson | 473/502 |
| 4,828,211 | 5/1989 | McConnell et al. | 248/311.2 |
| 4,868,954 | 9/1989 | Kasai | 24/601.2 |
| 4,978,093 | 12/1990 | Kennedy | 248/205.1 |
| 5,427,231 | 6/1995 | Williamann | 206/38 |
| 5,431,319 | 7/1995 | Cavadini et al. | 224/258 |
| 5,433,413 | 7/1995 | Adams | 248/205.3 |
| 5,450,661 | 9/1995 | Rekuc | 24/599.6 |
| 5,566,842 | 10/1996 | Dennis | 211/87 |

*Primary Examiner*—Ramon O. Ramirez
*Assistant Examiner*—Anita M. King
*Attorney, Agent, or Firm*—Norman E. Lehrer

[57] ABSTRACT

A coin cup holder mounted to the wall of a toilet stall located in a casino restroom includes a frame which has mounted on it a coin cup receptacle and a pair of hooks. The hooks include a coat hook and a swivel hook for supporting a purse. The coin cup holder may be mounted to a side wall, shared by adjacent stalls, via a bolt which goes through the wall and attaches to another holder mounted in the adjacent stall. The coin cup holder may also be mounted to a stall door.

5 Claims, 2 Drawing Sheets

COIN CUP HOLDER FOR A TOILET STALL

BACKGROUND OF THE INVENTION

The present invention is directed toward a coin cup holder which is mounted to the wall of a toilet stall located in a casino. The invention is also useful for holding a coat and a pocket book.

A problem people often face when entering a public restroom is the lack of a hook or holding device to support coats, purses, and other personal items within a stall. This problem is even more pronounced in casinos. Patrons of casinos who play the slot machines often walk around the casino with a cup that holds coins which they use to play the machines and/or have won from the machines. Coat hooks can generally be found in any bathroom stall; however, any other type of holder usually cannot be found within the stall. Furthermore, coin cup holders mounted on the stall wall are unknown.

Various holders to be used in restrooms are known and have been described in various patents. For example, U.S. Pat. No. Des. 71,202 to Nitsche discloses a wall mounted toilet rack which includes an open receptacle for supporting a cup or the like. U.S. Pat. Nos. 1,215,495 and 679,807 also disclose wall mounted receptacles for supporting a cup or another cylindrical object, therein. However, none of these patents discloses additionally securing a pair of hooks for supporting a coat and/or purse to the holder.

Similarly, U.S. Pat. Nos. 776,332; 897,072; and 5,427,231 disclose various wall mounted devices which are adapted to support a variety of objects. Each of these patents contains some means for supporting a cup or the like therein and additional hooks for supporting additional objects. Yet, none of these patents is intended to be secured to the wall of a bathroom stall for supporting a coin cup, coat, or purse.

SUMMARY OF THE INVENTION

The present invention is designed to overcome the deficiencies of the prior art discussed above. It is an object of the present invention to provide a coin cup holder within a toilet stall located in a casino.

It is another object of the present invention to provide a holder with a pair of hooks where the hooks are used to support a coat and a pocket book, respectively.

It is a further object of the present invention to provide holders which may be mounted to either side of a common side wall of adjacent toilet stalls located in a casino.

In accordance with the illustrative embodiments, demonstrating features and advantages of the present invention, there is provided a holder mounted to a wall of a toilet stall and which includes a frame with a cup receptacle extending outwardly therefrom. The cup receptacle is adapted to receive and support a casino coin cup therein. The holder may also have a pair of hooks secured thereon. One hook may be used to support a coat and the other hook may be a swivel hook for supporting a pocket book.

BRIEF DESCRIPTION OF THE DRAWINGS

For the purpose of illustrating the invention, there is shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 1:
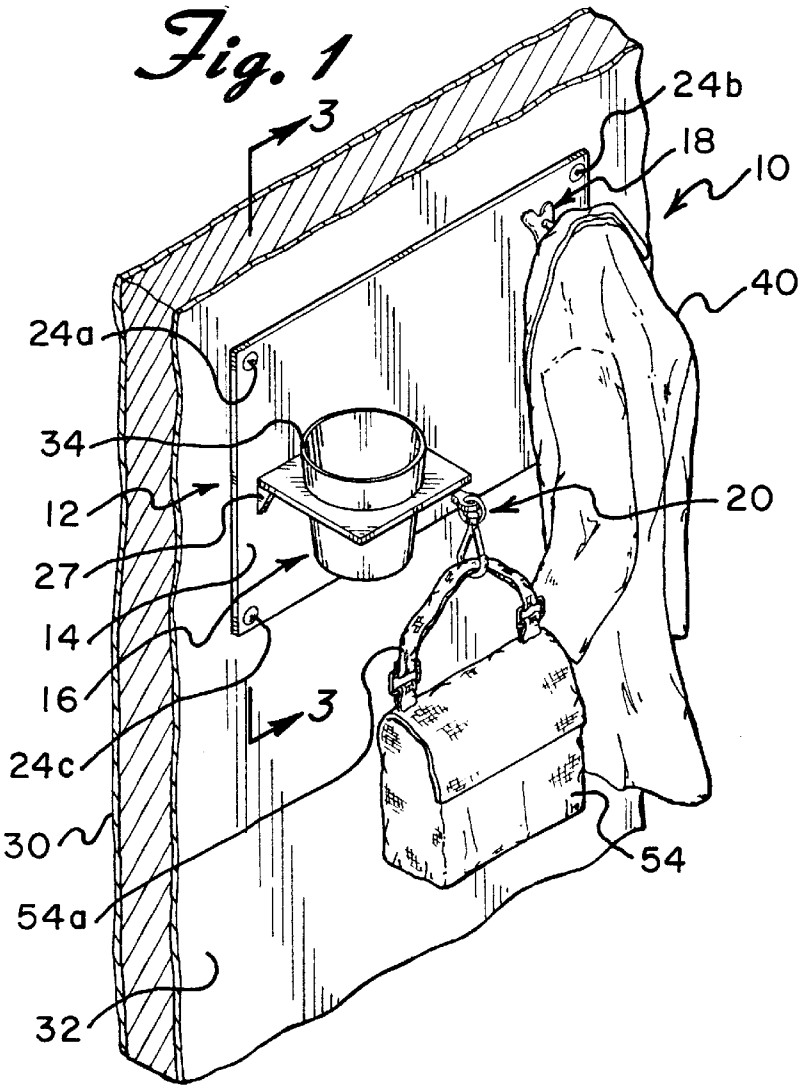
FIG. 1 is a front perspective view of the present invention including a right-handed coin cup holder mounted on a side wall of a toilet stall.

Referring now to the drawings in detail wherein like reference numerals have been used throughout the various figures to designate like elements, there is shown in FIG. 1 a coin cup holder constructed in accordance with the principles of the present invention and designated generally as 10.

Figure 2:
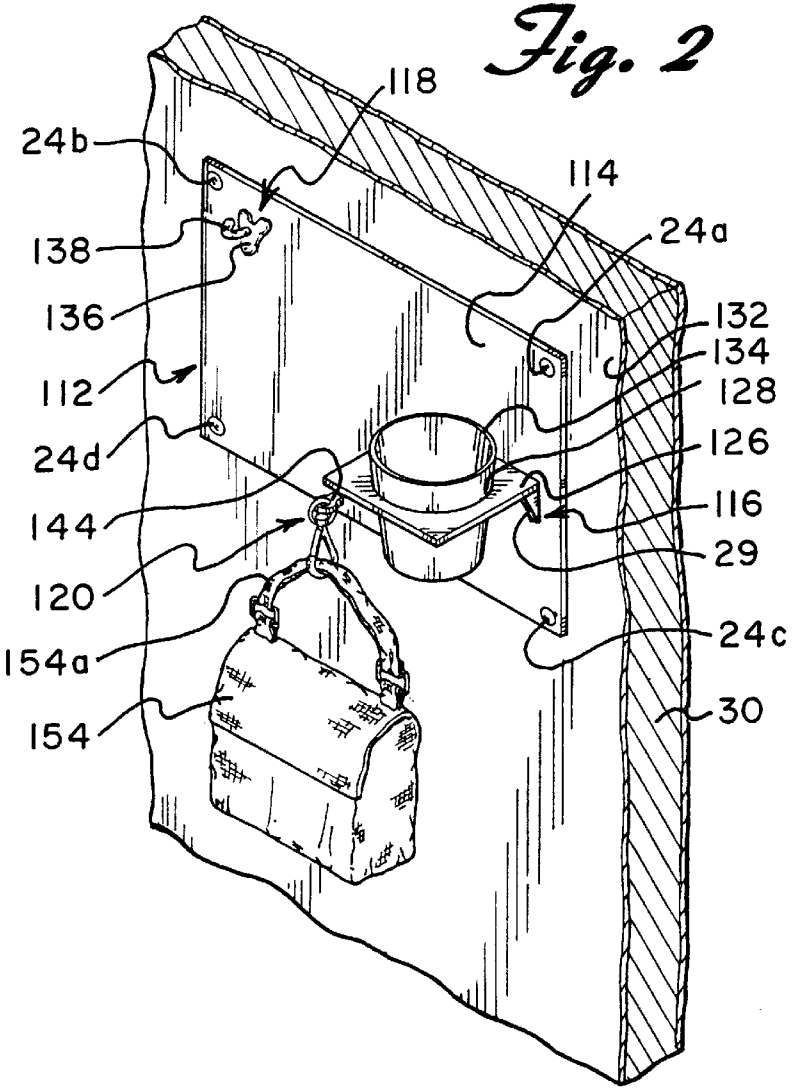
FIG. 2 is a front perspective view of the present invention including a left-handed coin cup holder mounted on the opposite side of the side wall in an adjacent toilet stall.

The coin cup holder may be made in what may generally be referred to as a right-handed holder 12 or a left-handed holder 112 as shown in FIGS. 1 and 2. The right-handed holder 12 is essentially a frame 14 with a coin cup receptacle 16, a coat hook 18, and a swivel hook 20 mounted thereon. The left-handed holder 112 includes the same elements as the right-handed holder but the coin cup receptacle 116 and swivel hook 120 are mounted on the frame 114 in positions opposite that of the coin cup receptacle 16 and swivel hook 20 of the right-handed holder 12, respectively, as seen in FIGS. 1 and 2.

Figure 4:
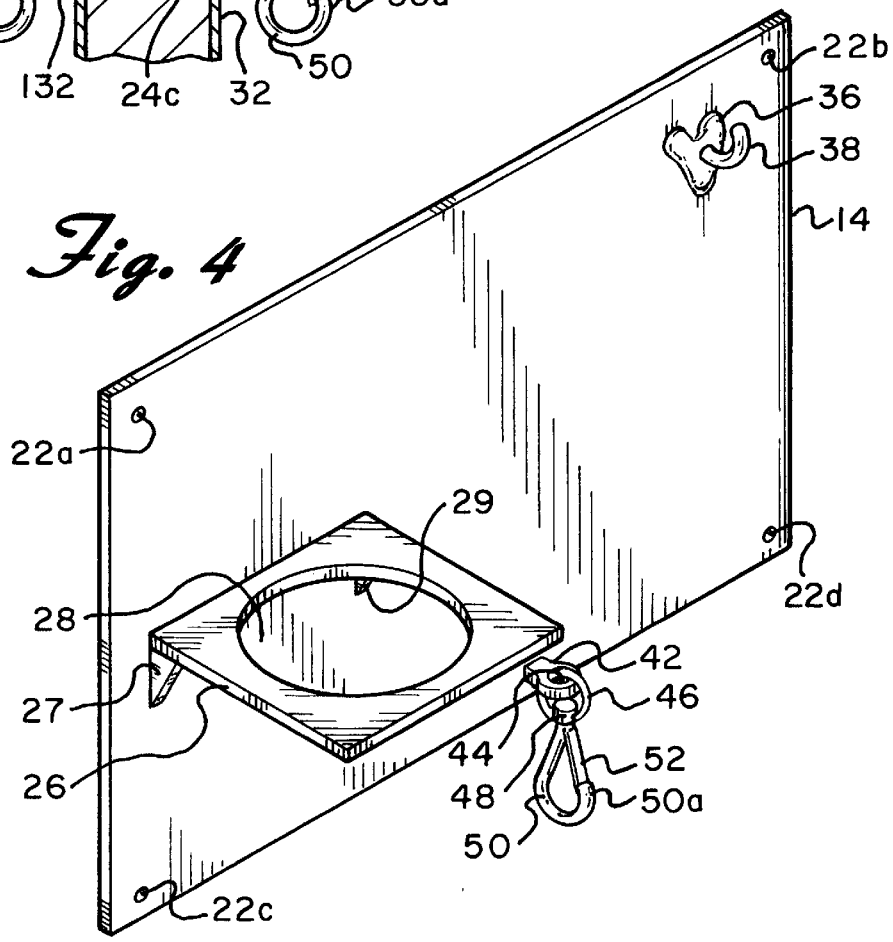
FIG. 4 is a front perspective view of the right-handed coin cup holder of the present invention.

Looking now at the individual elements of the right-handed holder 12, FIGS. 1 and 4 show a frame 14 which may be made of plastic or metal. Although the frame 14 is shown to be rectangular, virtually any shape may be used. Holes 22*a*, 22*b*, 22*c* and 22*d* are formed in each of the four comers of the frame 14 and bolts 24*a*–24*d* are screwed into the holes 22*a*–22*d*, respectively, thereby securing the frame 14 to the toilet stall side wall 30, as seen in FIG. 1. Preferably, the bolts 24*a*–24*d* should be long enough to go through the side wall 30 and protrude from the opposite side 132 of the side wall, into an adjacent stall so that a left-handed holder 112 may be secured in the adjacent stall, as will be further described.

The frame 14 of the right-handed holder 12 has a coin cup receptacle 16 mounted thereon. The receptacle 16 is generally a square plate 26 although almost any shape may be used. The plate 26 is made from metal or plastic with an opening 28 in the center thereof. The opening 28 should have a diameter of approximately four inches so that a casino coin cup 34 may be inserted therein from the top of the plate 26 and held in place. The plate 26 is mounted to the frame 14 and extends outwardly so that it is perpendicular to the frame 14. Any means of mounting known in the art, such as gluing or molding, may be used to secure the receptacle 16 to the frame 14. Triangular braces 27 and 29 may be utilized to help support the plate 26.

The frame 14 also has a pair of hooks 18 and 20. The first hook is a coat hook 18. Hook 18 has a base 36 mounted to the frame 14 and a hooked portion 38 secured to the base 36, as seen in FIG. 4. The hooked portion 38 is turned upwardly so that a coat 40 may be supported thereon. Again, any means of mounting, as discussed above, may be used to the secure the hooked portion 38 to the base 36 and the base 36 to the frame 14. Although a two-pronged base is shown in the figures, any shape may be used. A coat may be placed on the hooked portion and will be fully supported.

The second hook is a swivel hook 20 for supporting a purse 54. Hook 20 has a mount 42 secured to the frame 14 where the mount extends outwardly from the frame.

Figure 3:
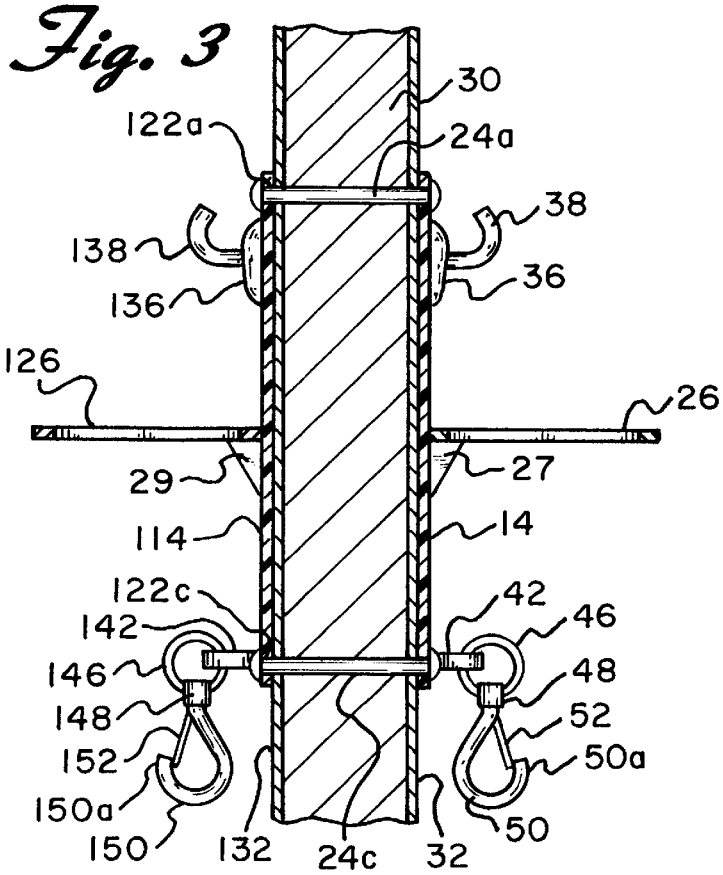
FIG. 3 is a cross-sectional view of the present invention taken along line 3—3 of FIG. 1.

Generally, hook 20 is secured at the bottom center of the frame 14, as seen in FIG. 1. Mount 42 has an opening 44 through which a ring 46 fits and is freely rotatable. Ring 46 has a cylindrical portion 48 and from this portion 48 a hooked portion 50 extends downwardly, with the hook facing away from the frame 14. A spring-biased retainer 52 is connected to the hooked portion 50 at an end of the hooked portion 50 closest to the cylindrical portion 48. The retainer 52 extends downwardly and away from the hooked portion 50 so that an end of the retainer abuts the tip 50*a* of the hooked portion, as seen in FIG. 3. When a purse 54 is to be supported on the hook 20, the purse strap 54*a* is pushed against the retainer 52 displacing the retainer 52 toward the frame 14. The purse strap 54*a* rests on the hooked portion 50, as seen in FIG. 1. Because the retainer 52 is spring-biased, it returns to abutting the tip 50*a* of the hooked portion 50 so that the purse 54 is fully supported by and locked into the hook 20. In this way, the swivel hook 20 not only provides a convenient way of holding a purse; it also secures the purse so that a thief would be unable to reach over the stall door and steal the purse.

Turning now to the left-handed holder 112, it can be seen that the left-handed holder 112 has the same elements as the above-discussed right-handed holder. (See FIG. 2.) Specifically, the left-handed holder 112 has a frame 114 which may be made of plastic or metal. Again, although the frame 114 is shown to be rectangular, virtually any shape may be used. A hole is formed in each of the four corners of the frame 114. Two such holes, 122*a* and 122*c*, are seen in FIG. 3. When mounting the frame 114 to the toilet stall side wall 30, the four holes of the frame 114 are aligned with the holes 22*a*–22*d* of the frame 14, against opposite sides 132 and 32 of the side wall, respectively, so that when the bolts 24*a*–24*d* are screwed into the holes 22*a*–22*d* of the frame 14 they protrude from the side 32 of the side wall of the first stall and into the adjacent stall. The bolts 24*a*–24*d* are then screwed farther into the holes of frame 114. In this manner, frames 14 and 114 are secured to opposite sides of the side wall 30. (See FIG. 3.)

Just as in the right-handed holder 12, the left-handed holder 112 also has a coin cup receptacle 116. Again, the coin cup receptacle 116 is a square plate 126 mounted to the frame 112. The plate 126 extends perpendicularly, outwardly from the frame 112 and has an opening 128 through which a casino coin cup 134 is inserted and held in place. The opening 128 should have a diameter of approximately four inches so that the casino coin cup 134 may be inserted into the opening 128 from the top of the plate 126 and held in place. As in the right-handed holder 12, the plate 126 of the left-handed holder 112 may be made of plastic or metal and may be any shape, square being the preferred shape. Again, any means of mounting known in the art, such as gluing or molding, may be used to secure the receptacle 116 to the frame 114. The coin cup receptacle 116 differs from the coin cup receptacle 16 of the right-handed holder 12 in that the receptacle 116 is mounted in a position directly opposite the coin cup receptacle 16 of the right-handed holder 12. (Compare FIGS. 1 and 2.) In other words, the receptacles 16 and 116 mirror each other, as seen in FIG. 3.

The frame 114 of the left-handed handle 112 also has a pair of hooks 118 and 120. The first hook is a coat hook 118. Hook 118 has a base 136 mounted to the frame 114 and a hooked portion 138 secured to the base 136, as seen in FIG. 2. Hooked portion 138 is turned upwardly so that a coat may be supported thereon. Again, any means of mounting, as discussed above, may be used to the secure the hooked portion 138 to the base 136 and the base 136 to the frame 114. Although a two-pronged base is shown in the figures, any shape may be used. A coat may be placed on the hooked portion 138 and will be fully supported. Hook 138 differs from the coat hook 38 of the right-handed holder 12 in that hook 138 is mounted in a position directly opposite the coat hook 38 of the right-handed holder 12 so that the hooks 38 and 138 mirror each other, as seen in FIG. 3.

The second hook is a swivel hook 120 for supporting a purse 154. Hook 120 has a mount 142 secured to the frame 114 where the mount extends outwardly from the frame 114. Hook 120 is usually found in the bottom center of the frame 114. Mount 142 has an opening 144 through which a ring 146 fits and is freely rotatable. Ring 146 has a cylindrical portion 148 and from portion 148 a hooked portion 150 extends downwardly, with the hook facing away from the frame 114. A spring-biased retainer 152 is connected to the hooked portion 150 at an end of the hooked portion closest to the cylindrical portion 148. Retainer 152 extends downwardly and away from the hooked portion 150 so that an end of the retainer 152 abuts the tip 150*a* of the hooked portion 150, as seen in FIG. 3. When a purse 154 is to be supported on the hook, the purse strap 154*a* is pushed against the retainer 152 displacing the retainer 152 toward the frame 114. The purse strap 154*a* rests on the hooked portion 150, as seen in FIG. 2, and the retainer 152 returns to abutting the tip 150a of the hooked portion 150 so that the purse 154 is fully supported by and locked into the hook. Again, this swivel hook secures the purse and prevents it from being stolen.

While the present invention has been described as being attached to a side wall of a toilet stall, one of ordinary skill in the art would realize that either the right-handed holder or left-handed holder may be attached to a toilet stall door in the same manner. One should realize however, that the bolts used to secure the holder to the door cannot be as long as the above-described bolts. Rather, the bolts should only fit through the stall door and not protrude from the outer side of the stall door.

The present invention may be embodied in other specific forms without departing from the spirit or essential attributes thereof and accordingly, reference should be made to the appended claims rather than to the foregoing specification as indicating the scope of the invention.

I claim:

1. The combination of a toilet stall and an arrangement for supporting casino coin cups and other personal belongings on the wall, comprising:

a first frame;

a cup holding means for holding a casino coin cup, said cup holding means being mounted in said first frame;

a pair of hooks secured to said first frame, one of said hooks being a swivel hook for holding a purse;

means for attaching said first frame to said stall wall, said attaching means including at least one hole in said first frame and a bolt which fits through said hole, said bolt having a length such that said bolt extends through the stall wall; and a second frame secured to said bolt.

2. The combination of a toilet stall wall and an arrangement of claim 1 further including a second cup holding means for holding a casino coin cup, said second holding means being mounted on said second frame; and a second pair of hooks secured to said second frame wherein one of said second pair of hooks is a swivel hook for holding a purse.

3. The combination of a toilet stall wall and an arrangement of claim 1 wherein said cup holding means includes a plate which extends outwardly from said first frame and has an opening in the center of said plate so that a coin cup may be inserted through said opening.

4. The combination of a toilet stall wall and an arrangement of claim 1 wherein one of said pair of hooks is a coat hook with a base which is mounted to said first frame and a hooked portion mounted to and extending outwardly from said base with said hooked portion facing upwardly so that a coat may be supported thereon.

5. The combination of a toilet stall wall and an arrangement of claim 1 wherein said swivel hook includes a mount secured to said first frame, said mount having an opening in the center thereof; a ring fitting through said opening and said ring having a cylindrical portion; a hooked portion connected to and extended downwardly from said cylindrical portion; and a retainer attached to said hooked portion and abutting an end of said hooked portion.

* * * * *